US007038151B2

(12) United States Patent
Amaduzzi

(10) Patent No.: US 7,038,151 B2
(45) Date of Patent: May 2, 2006

(54) DAMPED PRESSURE SWITCH

(75) Inventor: Roberto Amaduzzi, Rubiera (IT)

(73) Assignee: Arrow Line S.R.L., Rubiera (IT)

( * ) Notice: Subject to any disclaimer, the term of this patent is extended or adjusted under 35 U.S.C. 154(b) by 86 days.

(21) Appl. No.: 10/950,479

(22) Filed: Sep. 28, 2004

(65) Prior Publication Data

US 2005/0067266 A1 Mar. 31, 2005

(30) Foreign Application Priority Data

Sep. 30, 2003 (IT) ..... RE2003A0092

(51) Int. Cl.
*H01H 35/38* (2006.01)

(52) U.S. Cl. ..... 200/82 R; 200/82 C

(58) Field of Classification Search ..... 200/81 R, 200/81.9 R, 82 R, 82 B, 82 C, 82 A, 83 J
See application file for complete search history.

(56) References Cited

U.S. PATENT DOCUMENTS

| | | | | | |
|---|---|---|---|---|---|
| 4,752,658 | A | * | 6/1988 | Mack | 200/82 R |
| 4,827,093 | A | * | 5/1989 | Strzodka | 200/82 C |
| 5,089,673 | A | * | 2/1992 | Strzodka | 200/82 C |
| 5,187,337 | A | * | 2/1993 | Fujie et al. | 200/82 R |
| 5,317,954 | A | * | 6/1994 | Goans | 200/82 R |
| 5,554,834 | A | * | 9/1996 | Ellett | 200/82 A |

* cited by examiner

*Primary Examiner*—Michael A. Friedhofer
(74) *Attorney, Agent, or Firm*—Young & Thompson

(57) ABSTRACT

The pressure switch, constituted by a cylindrical body, comprises two portions which are interconnected; also, a first of the portions is connected to a micro-switch and the second to an inlet for pressurise fluid delivery. A stem is housed inside the cylindrical body and oscillates alternatively between an inactive position, with the micro-switch deactivated, and an active position, with the micro-switch activated by pressing. Elements for slowing a translation velocity of the stem are included between the stem and the inlet.

4 Claims, 2 Drawing Sheets

DAMPED PRESSURE SWITCH

BACKGROUND OF THE INVENTION

A pressure switch is a device used in various sectors, all having the requirement of using a switch which is piloted by a pressure.

The present invention relates to a special application of a pressure switch in the field of water-cleaning machines, and more precisely for activating a water gun, but it could be used in any application where installation of a pressure switch operating cyclically is required.

As is known, pressure switches are for activating or deactivating an electric circuit in accordance with a hydraulic pressure and can be used as control components to initiate, according to a pressure, a work cycle or to consent to continuation of operations or sequences, or stop them.

The prior art includes pressure switches of two types: with a piston or with a tubular spring.

Generally each piston pressure switch is constituted by an external body which internally has a stem which functions as an actuator, connected to a box containing a micro-switch, with an end of the stem being close to the micro-switch and the opposite end of the stem being connected to a hose for fluid delivery.

The fluid pressure acts on the piston, contrasted by an elastic means. If the hydraulic force generated by the liquid being delivered and operating on the piston exceeds the elastic force, the piston slides and touches the micro-switch, and the contacts commutate. When the fluid pressure is reduced below the threshold pressure level, i.e. the calibrated level of the pressure switch, the elastic force overcomes the hydraulic force and the piston returns into the neutral position, switching off the micro-switch.

The prior art, briefly described above, has been the subject of critical analysis because of intrinsic limitations and drawbacks connected with it.

Considering that the pressure switch is often mounted as a safety component, a high degree of durability and reliability is required of it.

An important aim of the invention is to provide a pressure switch in which the impact between the piston and the micro-switch is considerably damped, thus preventing damage of the circuit part on which the pressure switch acts.

A further important aim of the invention is to provide a device which consequently to the translating alternating cycle of the piston, prevents lacerations of the seals even after long operating periods.

A further important aim of the invention is to provide a pressure switch which guarantees equal performance in traditional assembly typologies but which can also be mounted in extreme positions, for example directly on the pump head, which is where the pressure gradients are highest.

The technical objective and specified aims are all attained by a pressure switch which is characterised in that it comprises one or more of the technical solutions described herein below.

SUMMARY OF THE INVENTION

The pressure switch, constituted by a cylindrical body, comprises two portions which are interconnected; also, a first of the portions is connected to a micro-switch and the second to an inlet for pressurise fluid delivery. A stem is housed inside the cylindrical body and oscillates alternatively between an inactive position, with the micro-switch deactivated, and an active position, with the micro-switch activated by pressing. Means for slowing a translation velocity of the stem are included between the stem and the inlet

BRIEF DESCRIPTION OF THE DRAWINGS

Some preferred but non-exclusive embodiments of the invention are now described by way of non-exclusive example, with the aid of the non-limiting figures of the drawings, in which.

DESCRIPTION OF THE PREFERRED EMBODIMENTS

With reference to the figures of the drawings, the damped pressure switch according to the invention is denoted in its entirety by 1.

Figure 1:
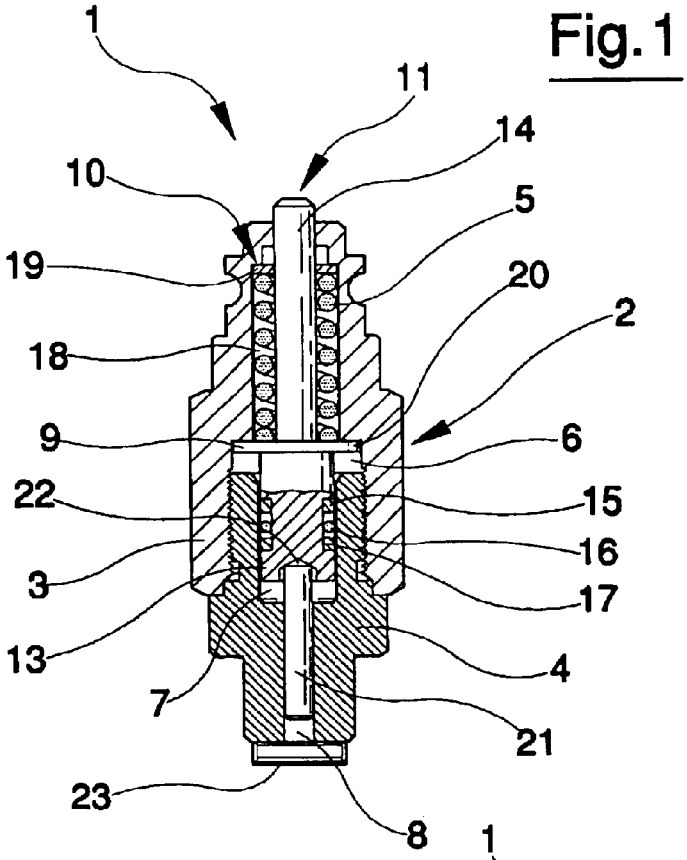
FIG. 1 is a view in section of the device of the invention, in an active position in which the piston is pressing against the micro-switch.

FIG. 1 shows the pressure switch 1 in the active position, which is reached when the pressure generated at the inlet of the switch exceeds the elastic force contrasting the pressure.

The pressure switch 1 is constituted by a cylindrical body 2 divided into two portions, one female portion 3, mechanically connected to a micro-switch (not shown in the figure) and a male portion 4, inferiorly in communication with a pressurised fluid delivery tube (also not shown in the figure), the two portions being connected one to the other by a screw connection.

Each portion exhibits an axial hole which when the two portions are connected defines a single internal through-channel, extending over the whole length of the body 2.

The male portion 4 exhibits, in the through-channel, at least one narrowing of the section thereof, defining a housing 7 and an inlet 8.

The female portion 3 exhibits, in the through-channel, a plurality of narrower sections, defining at least two chambers, namely an upper channel 5 upstream of a lower channel 6, the channels being cylindrical and adjacent one to the other; a striker seating 10 constituting a second end of the upper chamber 5.

A stem 11 is located internally of the body 2, which stem 11 is free to oscillate alternatingly and translatingly, along the through-channel, between an inactive position, in which it is completely immersed in the body 2, and an active position, in which the stem exits from the upper portion 3 in proximity of the connection zone with the micro-switch.

At a point along its development the stem 11 undergoes a section change, thus identifying in effect two cylindrical bodies, respectively a cylindrical-section broad body 13 and a smaller-section piston 14.

The broad body 13 of the stem 11 is housed inside the housing chamber 7 and at a distance of about half-way along the progression of the broad body 13 exhibits an annular recess in which seals are arranged, consisting of a first seal 15, an o-ring 16 and a second seal 17, which prevent the fluid from escaping from the housing chamber 7.

The piston develops from the point 12 of section change of the stem 11, and crosses a part of the lower chamber 6 and all of the upper chamber 5, terminating in proximity of the connection zone with the micro-switch.

A helix spring 18 is located coaxially to the stem 11 internally of the upper chamber 5. The helix spring 18 has ends thereof connected to pairs of washers 19, 20, which washers 19, 20 rest on the striker 10 and the point 12 where the stem 11 changes section.

A cylinder 21 is coupled with play internally of the inlet 8 of the male portion 4. The cylinder 21 is in communication at an end thereof with a part of the male portion 4 which is connected to the fluid delivery tube, and at another end thereof the cylinder 21 terminates in a seating 22 afforded in the broad body 13 of the stem 11.

Figure 2:
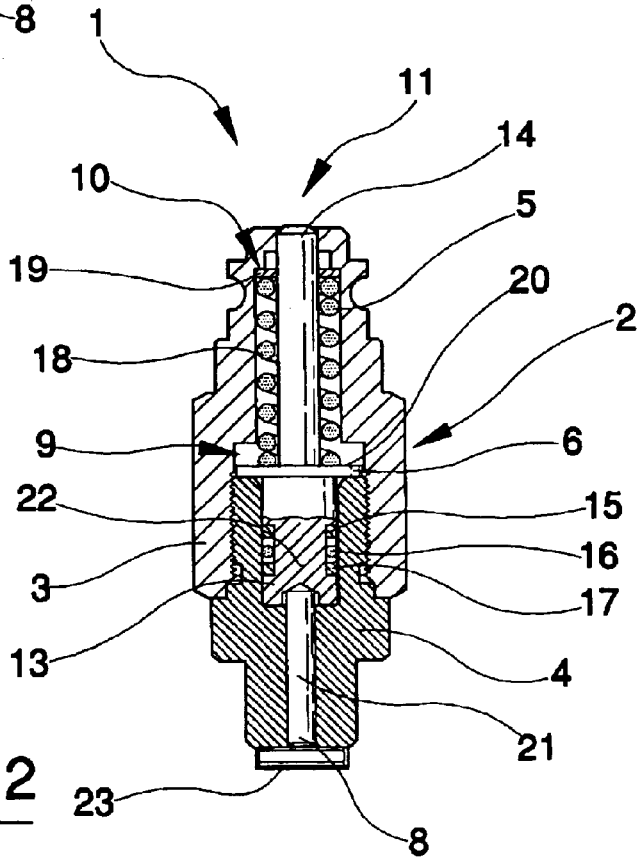
FIG. 2 is the same view in section as FIG. 1, in an inactive position where the piston has returned to the neutral position.

A plug 23 is located externally of the male portion 4, facing the fluid delivery tube; the plug 23 prevents the cylinder 21 from coming out of the hole 8 when returning to the inactive position (FIG. 2).

In a further embodiment, the cylinder 21, while retaining the coupling with play with the inlet 8, can be substituted by a nail-shaped body 25 having a cylindrical stalk 24 and a head 26 resting (not sealedly) on the base of the housing chamber 7; this is in substitution of the plug 23, and also prevents the cylinder 21 from exiting the seating.

Figure 3:
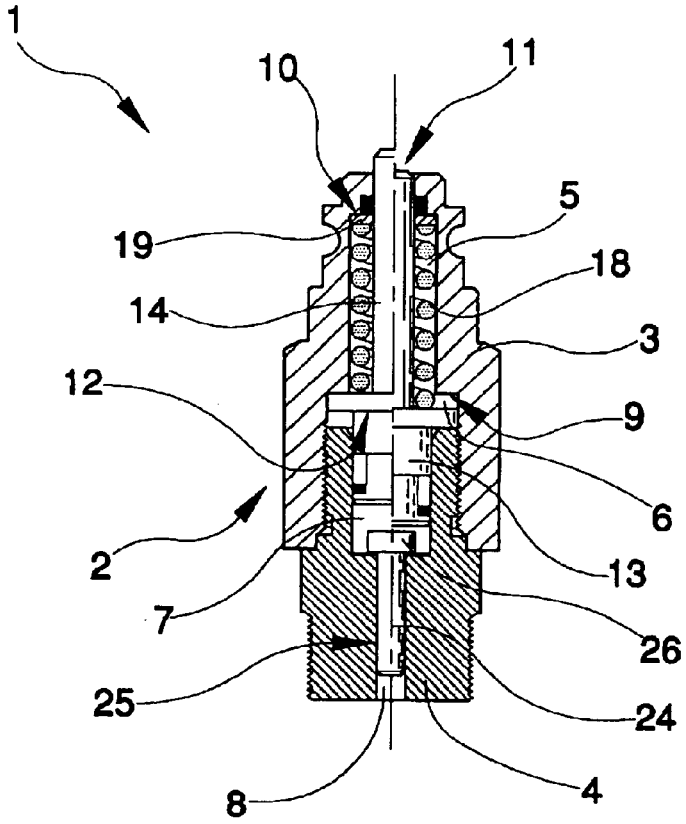
FIG. 3 is a view in section of the present invention in a further embodiment thereof, both in the active position and in the inactive position.

In any case the play between the cylinder 21 (24 in the embodiment of FIG. 3), and the seating in the inlet channel 8 is about 100 micron and is in any case comprised between 50 and 200 micron, measured as a diameter.

In a further embodiment the cylinder 21 can be substituted by a seal ball (not shown in the figures) interpositioned along the inlet channel 8.

In the inactive position (FIG. 2) the broad body 13 of the stem 11 lies in the lower position on the bottom of the housing chamber 7, held in position by the helix spring 18 which is in pre-load condition.

The piston 14, in this condition, is internal of the female portion 3 (FIG. 2).

The damped pressure switch 1 operates as described herein below.

When the fluid pressure increases, the fluid flow to the inlet 8 of the housing chamber 7 is slowed by the narrowed hole constituted by the play between the cylinder 21 and the inlet 8.

The slowed passage of the fluid generates a gradual increase in the pressure internally of the housing chamber 7, which leads to translation of the stem 11 and consequently the exit of the piston 14 from the female portion 3, thus activating the micro-switch it is facing.

Figure 4:
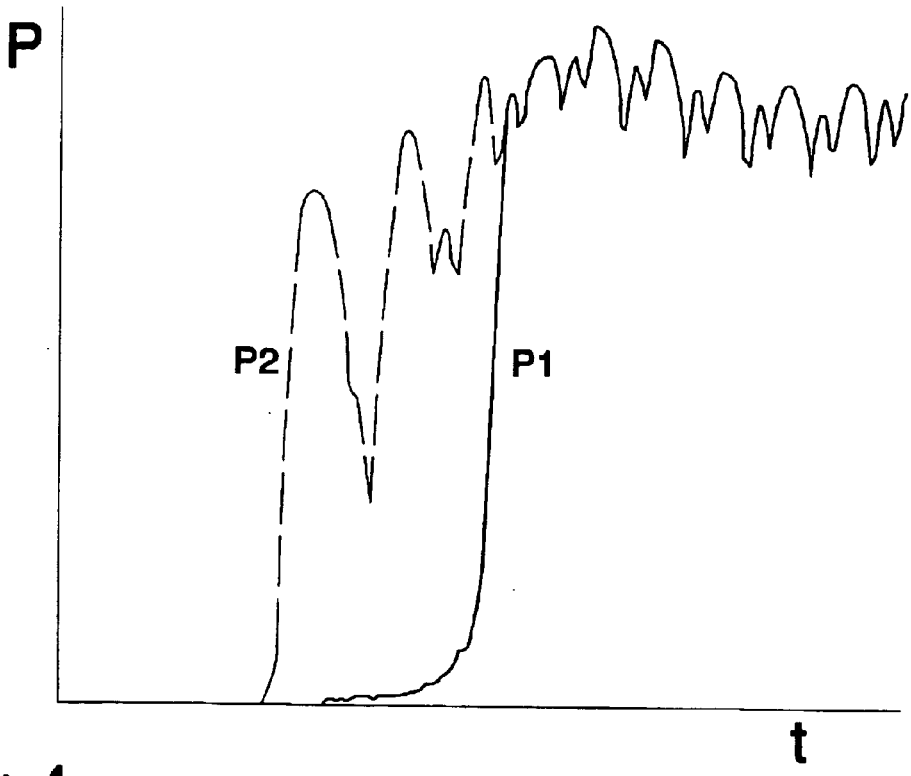
FIG. 4 is a graph showing the progression of the pressures over time, respectively in an internal position P1 in the pressure switch, and in an external position P2 close to the fluid inlet of the pressure switch, in a pressure switch according to the invention

The flow of fluid into the housing chamber 7 is slowed by the flow into the hole created by the play around the cylinder 21, 24, which has the effect of damping the oscillating components at the point where the threshold pressure is exceeded (see the diagram of FIG. 4).

The invention has undergone countless successful tests.

In particular a pressure transducer was mounted, communicating with the inside of the pressure switch (P1 in graph in FIG. 4) and a second reference transducer was mounted externally (P2 in graph in FIG. 4).

FIG. 4 shows the pressure levels recorded over a period of time.

Pressure P1 slowly increases up to about 30 bar, the threshold pressure, i.e. the pressure at which the piston 14 intervenes.

Beyond this pressure the stem 11 arrives at endrun and the pressure rapidly rises. After this transitory phase the two lines P1 and P2 perfectly coincide, which is a guarantee of the accuracy of the measurement.

This pressure progress demonstrates a slight delay in the stem run, due to a slowing of the pressure gradient, and more precisely to the damping of the transitory oscillations.

Thanks to this construction the movement of the piston 11 is subordinated to the passage of the fluid through the play in the coupling between the cylinder 21 and the hole 8 which enables a considerably slower translation than hitherto seen.

Notwithstanding the operational delay, of about 5 hundredths of a second, the effect on operativity is decidedly evident; the working life of the pressure switch is much greater, in particular that of the micro-switch to which it is connected, which is increased at least fourfold; in some cases wear was not sufficiently significant to produce malfunctioning even after several months of intermittent cycle operation.

It is also worth noting that even in the presence of limescale or other impurities, the cylinder 21 is not blocked, given the high pressures present, and after the first cycles these bodies are anyway expelled by the passage of water.

What is claimed is:

1. A damped pressure switch, comprising:

a cylindrical body having an inlet and internally containing a pressure-controlled stem which is free to oscillate alternatingly translatingly from an inactive position to an active position in which the stem protrudes from the cylindrical body;

wherein the switch comprises means for reducing a translation velocity of the stem from the inactive position to the active position, which means for reducing are interpositioned between the stem and the inlet.

2. The damped pressure switch of claim 1, wherein the means for reducing the translation velocity of the stem comprise:

a cylinder coupled with play internally of the inlet.

3. The damped pressure switch of claim 2, wherein in the coupling with play between the cylinder and the inlet, the play is comprised between 50 and 200 micron measured diametrally in relation to the cylinder.

4. The damped pressure switch of claim 1, wherein the means for reducing the translation velocity of the stem can be constituted by a body having a nail conformation, constituted by a head and a cylindrical stalk, the cylindrical stalk being coupled with play internally of the inlet.

* * * * *